US007239091B2

(12) United States Patent
Shinmen et al.

(10) Patent No.: US 7,239,091 B2
(45) Date of Patent: Jul. 3, 2007

(54) DISCHARGE LAMP LIGHTING APPARATUS FOR LIGHTING MULTIPLE DISCHARGE LAMPS

(75) Inventors: Hiroshi Shinmen, Iwata-gun (JP); Mitsuo Matsushima, Iwata-gun (JP); Kohei Nishibori, Iwata-gun (JP)

(73) Assignee: Minebea Co., Ltd., Nagano (JP)

( * ) Notice: Subject to any disclaimer, the term of this patent is extended or adjusted under 35 U.S.C. 154(b) by 123 days.

(21) Appl. No.: 11/190,932

(22) Filed: Jul. 28, 2005

(65) Prior Publication Data

US 2006/0028147 A1 Feb. 9, 2006

(30) Foreign Application Priority Data

Aug. 3, 2004 (JP) ..... 2004-226648

(51) Int. Cl.
*H05B 37/02* (2006.01)

(52) U.S. Cl. ..... 315/224; 315/277; 315/308; 315/312

(58) Field of Classification Search ..... 315/209 R, 315/210–213, 219–220, 224, 226, 255, 258–259, 315/277–278, 283–284, 287, 291, 307–308, 315/312, 324, DIG. 7
See application file for complete search history.

(56) References Cited

U.S. PATENT DOCUMENTS 4,016,477 A * 4/1977 Ghiringhelli ..... 363/64
4,547,705 A * 10/1985 Hirayama et al. ..... 315/219
6,188,209 B1 2/2001 Poon et al. ..... 323/255
6,232,726 B1 5/2001 Janczak ..... 315/224
6,515,427 B2 * 2/2003 Oura et al. ..... 315/141
6,703,796 B2 * 3/2004 Che-Chen et al. ..... 315/291
6,717,372 B2 * 4/2004 Lin et al. ..... 315/282
6,731,075 B2 * 5/2004 Pak ..... 315/274
6,784,627 B2 * 8/2004 Suzuki et al. ..... 315/291
2003/0085669 A1 * 5/2003 Pak ..... 315/224
2004/0017163 A1 * 1/2004 Hsu ..... 315/224
2004/0046512 A1 3/2004 Suzuki et al. ..... 292/173
2004/0183477 A1 * 9/2004 Newman et al. ..... 315/291
2005/0035730 A1 * 2/2005 Blum ..... 315/312

FOREIGN PATENT DOCUMENTS

JP A 11-260580 9/1999

* cited by examiner

*Primary Examiner*—Trinh Dinh
*Assistant Examiner*—Tung Le
(74) *Attorney, Agent, or Firm*—Oliff & Berridge, PLC

(57) ABSTRACT

A discharge lamp lighting apparatus is provided for lighting a plurality of discharge lamps including one reference lamp and at least one controllable lamp. First variable inductance element and lamp current detecting unit are connected to the reference lamp, second variable inductance and lamp current unit are connected to the controllable lamp, and a lamp current controlling circuit is connected to each of the first and second variable inductance elements. An output signal from the second lamp current detecting unit and also an output signal as a reference signal from the first lamp current detecting unit are connected to the lamp current controlling circuit for the controllable lamp, whereby the lamp current of the controllable lamp is controlled. The reference output signal is also connected to a control circuit, and the lamp currents of the reference and controllable lamps are controlled further by the on/off operation of the switching elements.

8 Claims, 5 Drawing Sheets

DISCHARGE LAMP LIGHTING APPARATUS FOR LIGHTING MULTIPLE DISCHARGE LAMPS

BACKGROUND OF THE INVENTION

1. Field of the Invention

The present invention relates to a discharge lamp lighting apparatus, and more particularly to a discharge lamp lighting apparatus to light a plug of discharge lamps.

2. Description of the Related Art

A liquid crystal display (LCD) apparatus as a flat panel display apparatus is used in various applications. Since a liquid crystal in the LCD apparatus does not emit light by itself, a lighting device is required separately in order to achieve a good display. A backlight device to light a liquid crystal panel from behind is one type of lighting device. The backlight device uses primarily a cold cathode lamp as a discharge lamp and incorporates a discharge lamp lighting apparatus including an inverter to drive the cold cathode lamp.

Recently, the LCD apparatus is becoming larger and larger for use in, for example, a large-screen TV, and therefore a plurality of discharge lamps are used in a backlight device in order to achieve sufficient screen brightness for the LCD apparatus. In such a backlight device, if brightness varies from one discharge lamp to another, the display screen of the LCD apparatus incurs non-uniformity thus significantly degrading the display quality. So, not only high luminance of each discharge lamp but also uniformity in brightness of all the discharge lamps is required. Further, cost reduction of the discharge lamp lighting apparatus is strongly requested due to the price reduction of the LCD apparatus.

The brightness variation over the discharge lamps can be prevented by equalizing lamp currents flowing through respective discharge lamps. The lamp currents can be equalized by such a method that transformers that are provided in a number equal to the number of the discharge lamps are individually controlled by respective control ICs. This approach, however, requires an increased number of components thus pushing up cost, which eventually results in an increased cost of the discharge lamp lighting apparatus.

The lamp currents can alternatively be equalized by providing balance coils, but this alternative approach requires a large number of balance coils for multiple discharge lamps, and the balance coils must be designed individually with different specifications because the values of currents flowing through the balance coils differ from one another depending on the places where the balance coils are disposed. Consequently, the number of components is increased pushing up the cost on the discharge lamp lighting apparatus.

A discharge lamp lighting apparatus is proposed (refer to, for example, Japanese Patent Application Laid-Open No. H11-260580) as still another approach. In the discharge lamp lighting apparatus, inductance values are controlled by variable inductance elements, rather than balance coils, so as to control respective lamp currents and reduce the variation in brightness of the discharge lamps for uniform brightness over the display screen.

FIG. 5 is a circuitry of the discharge lamp lighting apparatus which is disclosed in the aforementioned Japanese Patent Application Laid-Open No. H11-260580, and in which two discharge lamps are provided.

Referring to FIG. 5, field effect transistors (FETs) 102 and 103 as switching elements are connected in series between the positive and negative electrodes of a DC power supply 101, and the connection portion of the source terminal of the FET 102 and the drain terminal of the FET 103 is connected to the negative electrode of the DC power supply 101 via a series resonant circuit 120A which includes a capacitor 122*a* and a winding 121*a* of an orthogonal transformer 121A constituting an variable inductance element, and also via a series resonant circuit 120B which includes a capacitor 122*a* and a winding 121*a* of an orthogonal transformer 121B constituting an variable inductance element.

The connection portion of the winding 121*a* of the orthogonal transformer 121A and the capacitor 122*a* is connected to the negative electrode of the DC power supply 101 via a series circuit including a capacitor 110*a*, a discharge lamp 111*a*, and a current detecting resistor 123*a* of a control circuit 123A, and an output signal of the control circuit 123A is fed to a control winding 121*b* of the orthogonal transformer 121A.

The control circuit 123A supplies a control current to the control winding 121*b* of the orthogonal transformer 121A, and is arranged such that the connection portion of the discharge lamp 111*a* and the current detecting resistor 123*a* is connected to the inverting input terminal of an operation amplifying circuit 123*c* via a rectifier diode 123*b*, the connection portion of the rectifier diode 123*b* and the inverting input terminal of the operation amplifying circuit 123*c* is connected to the negative electrode of the DC power supply 101 via a smoothing capacitor 12*d*, the non-inverting terminal of the operation amplifying circuit 123*c* is connected to the negative electrode of the DC power supply 101 via a battery 123*e* having a reference voltage Vref to determine a reference value of a current of the discharge lamp 111*a*, and that the output terminal of the operation amplifying circuit 123*c* is connected to the negative electrode of the DC power supply 101 via the control winding 121*b* of the orthogonal transformer 121A.

The control circuit 123A functions to control the current of the discharge lamp 111*a*. Specifically, the control circuit 123A operates such that when the current of the discharge lamp 111*a* is to be increased, the control current of the control winding 121*b* of the orthogonal transformer 121A is increased so as to decrease the inductance value of the winding 121*a* of the orthogonal transformer 121A thereby increasing the resonant frequency $f_0$ the series resonant circuit 120A thus decreasing the impedance of the series resonant circuit 120A at a driving frequency consequently resulting in an increase of a voltage generated across the both ends of the capacitor 122*a*, and such that when the current of the discharge lamp 111*a* is to be decreased, the control current of the control winding 121*b* of the orthogonal transformer 121A is decreased so as to increase the inductance value of the winding 121*a* of the orthogonal transformer 121A thereby decreasing the resonant frequency $f_0$ the series resonant circuit 120A thus increasing the impedance of the series resonant circuit 120A at a driving frequency consequently resulting in a decrease of a voltage generated across the both terminals of the capacitor 122*a*.

There is provided another circuit which includes the orthogonal transformer 121B, and which is constituted identically and functions identically with the above-described circuit including the orthogonal transformer 121A.

In the discharge lamp lighting apparatus shown in FIG. 5, the currents flowing through the discharge lamps 111*a* and 111*b* are controlled at a predetermined value while a switching frequency of a control signal to be supplied from a control circuit 104 to the FETs 102 and 103 is set at a fixed value without a switching frequency control, thus uniform brightness between the discharge lamps 111*a* and 111*b* is achieved without performing a complicated frequency control at the control circuit 104.

A high voltage of about 1,500 to 2,500 V is required to turn on a cold cathode lamp, and a voltage of about 600 to 1,300 V must be applied to keep the cold cathode lamp lighted on. Accordingly, a power supply to supply such a high voltage is required in a discharge lamp lighting apparatus. Since the discharge lamp lighting apparatus shown in FIG. 5 is not provided with a step-up circuit, the DC power supply 101 outputs a high voltage in order to duly turn on the discharge lamps 111*a* and 111*b*.

Also, since the FETs 102 and 103 to turn on the discharge lamps 111*a* and 111*b*, and the control circuit 104 to control the FETs 102 and 103 are connected to the DC power supply 101 to output a high voltage, the FETs 102 and 103 and the control circuit 104 must be composed of high withstand voltage materials which are expensive, thus pushing up the cost of the components, and eventually the cost of the apparatus.

Further, in the discharge lamp lighting apparatus shown in FIG. 5, the capacitors 110*a* and 110*b*, which are current controlling capacitors (so-called "ballast capacitors") to stabilize the lamp currents of the discharge lamps 111*a* and 111*b*, are connected in series to the discharge lamps 111*a* and 111*b*, respectively, and a high voltage is applied to the capacitors 110*a* and 110*b*. Consequently, the capacitors 111*a* and 110*b* must also be composed of high withstand voltage materials, and since the current controlling capacitors must be provided in a number equal to the number of discharge lamps to be driven, the coat of the apparatus is pushed up definitely. Also, since a high voltage is applied to the capacitors 110*a* an 110*b* an described above, there is a problem also in terms of component safety.

Further, in the discharge lamp lighting apparatus shown in FIG. 5, since the lamp current is controlled by a variable inductance element only, a sufficient variation range must be secured for the variable inductance element in order to duly control the lamp current. Thus, the variable inductance element must be increased in dimension so as to get its maximum inductance value increased. However, if such a discharge lamp lighting apparatus is incorporated in, for example, a backlight device for a low-profile TV, components in the apparatus are forced to have a limited height from a printed board, which makes it difficult to increase the dimension of the variable inductance element to be mounted on the printed board.

And, since impedance is increased with an increase of inductance, when the maximum inductance value of the variable inductance element is increased, it is necessary to increase also a voltage to be supplied to the discharge lamp via the variable inductance element. Accordingly the load of the DC power supply 101 to output a high voltage is increased, and the loads of elements constituting the FETs 102 and 103 and the control circuit 104 to light the discharge lamps 111*a* and 111*b* are also increased. Consequently those components must be composed of high withstand voltage materials which are expensive, thus pushing up the cost of the components, and eventually the cost of the apparatus.

SUMMARY OF THE INVENTION

The present invention has been made in light of the problems described above, and it is an object of the present invention to provide a discharge lamp lighting apparatus for lighting a plurality of discharge lamps, in which currents flowing through the plurality of discharge lamps are equalized so as to reduce variation in brightness of the discharge lamps without increasing the number of components using high withstand voltage materials thus contributing to reduction of production cost, and in which lamp currents are controlled extensively and precisely without increasing the dimension of variable inductances.

In order to achieve the object described above, according to a first aspect of the present invention, a discharge lamp lighting apparatus, which lights a plurality of discharge lamps, includes: a DC power supply; a control circuit to output signals; a step-up transformer defining a primary side and a secondary side; and switching elements connected to the DC power supply and adapted to drive the primary side of the step-up transformer based on the signals from the control circuit so as to light the plurality of discharge lamps which include one reference discharge lamp and at least one controllable discharge lamp, and which are connected to the secondary side of the step-up transformer. The discharge lamp lighting apparatus further includes: a first variable inductance element provided between one terminal of the secondary side of the step-up transformer and one terminal of the reference discharge lamp; a first lamp current detecting unit connected to the other terminal of the reference discharge lamp; a first lamp current controlling circuit connected to the first variable inductance element; a first series resonant circuit constituted by a leakage inductance of the step-up transformer, an inductance of the first variable inductance element, and a capacitance of capacitors provided between the first variable inductance element and the reference discharge lamp; at least one second variable inductance element provided between the one terminal of the secondary side of the step-up transformer and one terminal of the controllable discharge lamp; at least one second lamp current detecting unit connected to the other terminal of the controllable discharge lamp; at least one second lamp current controlling circuit connected to the second variable inductance element; and at least one second series resonant circuit constituted by the leakage inductance of the step-up transformer, an inductance of the second variable inductance element, and capacitors provided between the second variable inductance element and the controllable discharge lamp. In the discharge lamp lighting apparatus described above, an output signal from the first lamp current detecting unit connected to the reference discharge lamp and also an output signal from the second lamp current detecting unit connected to the controllable discharge lamp are connected to the second lamp current controlling circuit for the controllable discharge lamp, and an output signal from the second lamp current controlling circuit for the controllable discharge lamp is connected to the second variable inductance element for the controllable discharge lamp so as to vary the inductance of the second variable inductance element for the controllable discharge lamp thereby controlling a lamp current of the controllable discharge lamp.

Since the output signal from the first lamp current detecting unit for the reference discharge lamp acts as a reference signal to generate the output signal for the second lamp current controlling circuit for the controllable discharge lamp, a circuit to generate such a reference signal is not additionally required thus contributing to reduction in the number of components. And, since the lamp current of the controllable discharge lamp is automatically determined on the basis of the lamp current of the reference discharge lamp, the lamp currents flowing through the plurality of discharge lamps can be equalized by setting the current value of the reference discharge lamp only, thus simplifying the design work.

In the first aspect of the present invention, the output signal from the first lamp current detecting unit for the reference discharge lamp may be also connected to the control circuit so that the control circuit controls on/off operation of the switching elements according to the output signal from the first lamp current detecting unit for the reference discharge lamp. If the on/off operation of the switching elements is combined with an impedance adjustment by the variable inductance elements, the lamp currents flowing through the plurality of discharge lamps can be extensively controlled and precisely equalized with one another.

In first the aspect of the present invention, the first lamp current controlling circuit for the reference discharge lamp may be a constant current circuit, and the inductance of the first variable inductance element functioning for the reference discharge lamp and connected to the constant current circuit may be maintained approximately at $Lmin+\Delta L/2$, where Lmin is a minimum value of the inductance of the first variable inductance element for the reference discharge lamp, and $\Delta L$ is a variance width of the first variable inductance element for the reference discharge lamp. Since the inductance of the variable inductance element for the controllable discharge lamp is also controlled in the vicinity of $Lmin+\Delta L/2$, the inductance range controllable can be effectively utilized thus minimizing the variation width for the variable inductance element, which results in downsizing of the variable inductance element. Accordingly, components of a high withstand voltage, which are required to deal with a large impedance of the variable inductance element, are less required, which contributes to reduction in component cost and also as in mounting area and height.

In the first aspect of the present invention, the second lamp current controlling circuit for the controllable discharge lamp may include an operational amplifier and a transistor, the output signal from the second lamp current detecting unit for the controllable discharge lamp and the output signal from the first lamp current detecting unit for the reference discharge lamp may be inputted to the operational amplifier, an output from the operational amplifier is connected to a base terminal of the transistor, and a collector terminal of the transistor may be connected to the second variable inductance element for the controllable discharge lamp, whereby the inductance of the second variable inductance element for the controllable discharge lamp is variably controlled.

In the first aspect of the present invention, the first and second variable inductance elements may each constitute a transformer, and a snubber circuit may be connected across both terminals of a control winding of the transformer. Consequently, a high spike voltage is prevented when back-emf is generated.

In the first aspect of the present invention, the discharge lamp lighting apparatus may be incorporated in a backlight device for a liquid crystal display apparatus. This enables the backlight device and eventually the liquid crystal display apparatus to enjoy the advantages described above.

According to a second aspect of the present invention a discharge lamp lighting apparatus, which lights a plurality of discharge lamps, includes: a DC power supply; a control circuit to output signals; a step-up transformer defining a primary side and a secondary side; switching elements connected to the DC power supply and adapted to drive the primary side of the step-up transformer based on the signals from the control circuit so as to light the plurality of discharge lamps which include one reference discharge lamp and at least one controllable discharge lamp, and which are connected to the secondary side of the step-up transformer. The discharge lamp lighting apparatus further includes: an inductance element provided between one terminal of the secondary side of the step-up transformer and one terminal of the reference discharge lamp; a first lamp current detecting unit connected to the other terminal of the reference discharge lamp; a first series resonant circuit constituted by a leakage inductance of the step-up transformer, an inductance of the inductance element, and a capacitance of a capacitance element together with a stray capacitance provided between the inductance element and the reference discharge lamp; at least one variable inductance element provided between the one terminal of the secondary side of the step-up transformer and one terminal of the controllable discharge lamp; at least one second lamp current detecting unit connected to the other terminal of the controllable discharge lamp; at least one lamp current controlling circuit connected to the variable inductance element; and at least one second series resonant circuit constituted by the leakage inductance of the step-up transformer, an inductance of the variable inductance element, and a capacitance of a capacitance element together with a stray capacitance provided between the variable inductance element and the controllable discharge lamp. In the discharge lamp lighting apparatus described above, an output signal from the first lamp current detecting unit connected to the reference discharge lamp and also an output signed from the second lamp current detecting unit connected to the controllable discharge lamp are connected to the lamp current controlling circuit for the controllable discharge lamp, and an output signal from the lamp current controlling circuit for the controllable discharge lamp is connected to the variable inductance element for the controllable discharge lamp so as to vary the inductance of the variable inductance element for the controllable discharge lamp thereby controlling a lamp current of the controllable discharge lamp. This structure reduces the number of components, thus contributing to cost reduction.

According to a third aspect of the present invention, a discharge lamp lighting apparatus, which lights a plurality of discharge lamps, includes: a DC power supply; a control circuit to output signals; a step-up transformer defining a primary side and a secondary side; and switching elements connected to the DC power supply and adapted to drive the primary side of the step-up transformer based on the signals from the control circuit so as to light the plurality of discharge lamps which include one reference discharge lamp and at least one controllable discharge lamp, and which are connected to the secondary side of the step-up transformer. The discharge lamp lighting apparatus further includes: a capacitance element provided at one terminal of the secondary side of the step-up transformer); a first variable inductance element provided between the capacitance element and one terminal of the reference discharge lamp; a first lamp current detecting unit connected to the other terminal of the reference discharge lamp; a first lamp current controlling circuit connected to the first variable inductance element; a first series resonant circuit constituted by a leakage inductance of the step-up transformer and the capacitance element; at least one second variable inductance element provided between the capacitance element and one terminal of the controllable discharge lamp; at least one second lamp current detecting unit connected to the other terminal of the controllable discharge lamp; and at least one second lamp current controlling circuit connected to the second variable inductance element. In the discharge lamp lighting apparatus described above, an output signal from the first lamp current detecting unit connected to the reference discharge lamp and also an output signal from the second lamp current detecting unit connected to the controllable discharge lamp are connected to the second lamp current controlling circuit for the controllable discharge lamp, and an output signal from the second lamp current controlling circuit for the controllable discharge lamp is connected to the second variable inductance element for the controllable discharge lamp so as to vary the inductance of the second variable inductance element for the controllable discharge lamp thereby controlling a lamp current of the controllable discharge lamp. This structure reduces the number of components, thus contributing to cost reduction.

DETAILED DESCRIPTION OF THE PREFERRED EMBODIMENTS

Preferred embodiments of the present invention will hereinafter be described with reference to the accompanying drawings.

Figure 1:
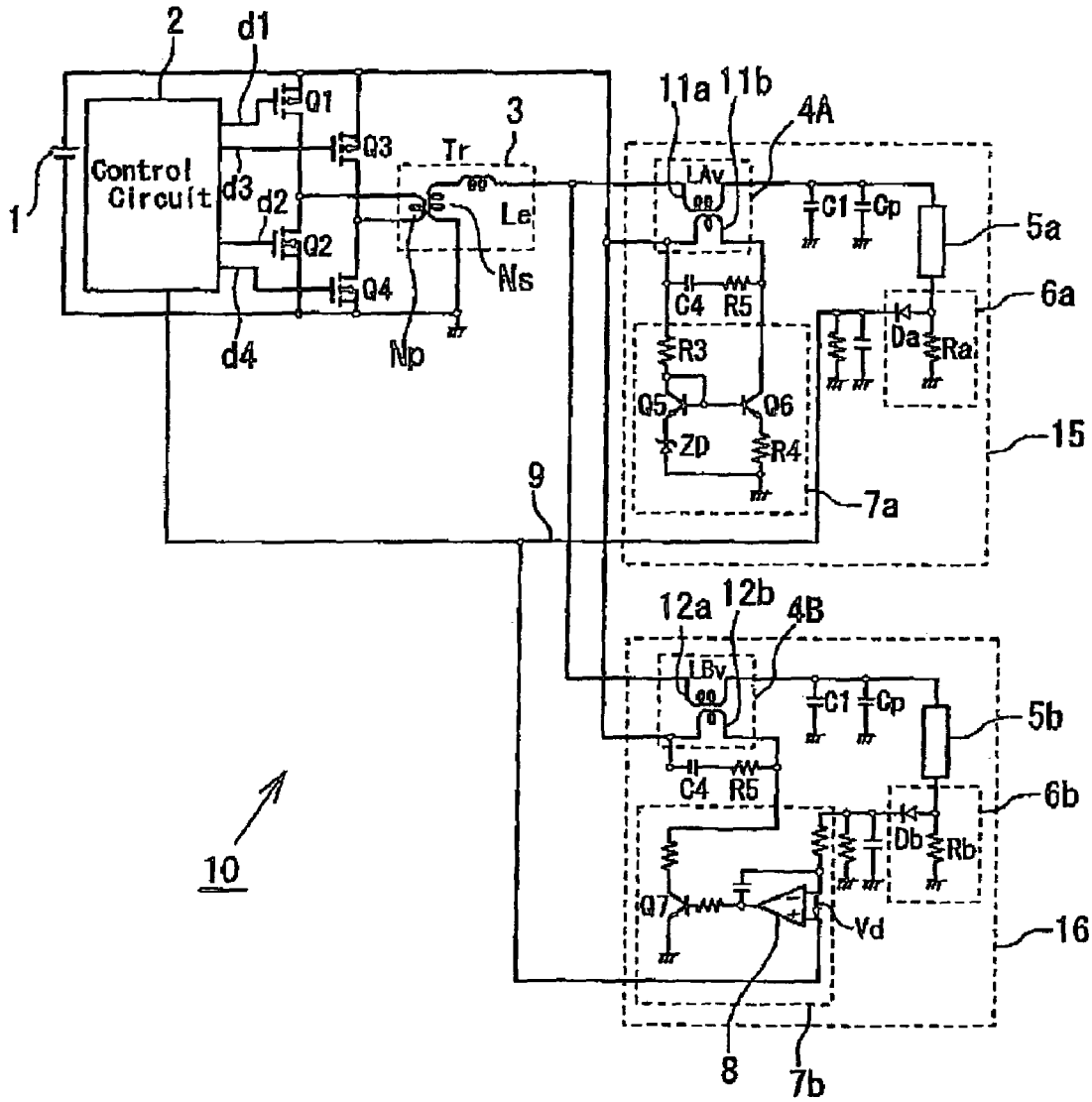
FIG. 1 is a circuitry of a discharge lamp lighting apparatus for lighting a plurality of discharge lamps, according to a first embodiment of the present invention.

Referring to FIG. 1, a discharge lamp lighting apparatus 10 according to a first embodiment of the present invention is adapted to light a plurality (two in the present embodiment) of discharge lamps 5*a* and 5*b*, for example cold-cathode tubes. In the discharge lamp light apparatus 10, a series circuit including transistors Q1 and Q2 as switching elements and a series circuit including transistors Q3 and Q4 as switching elements are connected in parallel across both electrodes of a DC power supply 1, and the connection portion of the transistors Q1 and Q2 is connected to one terminal of a primary winding NP of a step-up transfer 3 while the connection portion of the transistors Q3 and Q4 is connected to the other terminal of the primary winding Np of the step-up transformer 3, whereby what is called "a full-bridge connection" is formed.

A control circuit 2 controls the discharge lamp lighting apparatus 10, includes an oscillation circuit to set a driving frequency for driving the primary side of the step-up transformer 3, and outputs gate driving signals d1, d2, d3 and d4 to turn on and off the transistors Q1, Q2, Q3 and Q4 at predetermined timings, thereby generating an AC voltage. The driving frequency is set higher than resonant frequencies of series resonant circuits (to be described later) formed at the secondary side of the step-up transformer 3, and an output signal 9 from a lamp current detecting unit 6*a* (to be described later) for the discharge lamp 5*a* is connected to the control circuit 2.

In the present embodiment, "a full-bridge connection" constituted by the transistors Q1 to Q4 is established at the primary side of the step-up transformer 3 as described above, but the present invention is not limited to such a full-bridge structure but may alternatively be structured with a half-bridge connection. The full-bridge connection, however, enables a more efficient switching operation than the half-bridge connection and therefore is preferred.

The step-up transformer 3 has the discharge lamps 5*a* and 5*b* connected at the secondary side thereof. One terminal of a secondary winding Ns of the step-up transformer 3 is connected to one terminals of the discharge lamps 5*a* and 5*b* via respective windings 11*a* and 12*a* of transformers 4A and 4B as variable inductance elements, while the other terminal of the secondary winding Ns is grounded. In the present embodiment, the discharge lamp 5*a* is a reference lamp, the discharge lamp 5*b* is a controllable lamp, and the lamp current of the discharge lamp 5*b* as a controllable lamp is controllably determined on the basis of the lamp current of the discharge lamp 5*a* as a reference lamp.

Secondary side lighting circuits 15 and 16 including the discharge lamps 5*a* and 5*b*, respectively, and the operations thereof will be described. As described above, series resonant circuits are formed at the secondary side of the step-up transformer 3. One series resonant circuit is formed by a leakage inductance Le of the step-up transformer 3, an inductance LAv of the winding 11*a* of the transformer 4A, and an capacitance of capacitors C1 and Cp disposed between the transformer 4A and the discharge lamp 5*a*, and another series resonant circuit is formed by the leakage inductance Le of the step-up transformer 3, an inductance LBv of the winding 12*a* of the transformer 4B, and an capacitance of capacitors C1 and Cp disposed between the transformer 4B and the discharge lamp 5*b*. Here, the capacitor C1 is connected in the circuit and adapted to adjust a resonant frequency, and the capacitor Cp is a stray capacitance.

The aforementioned lamp current detecting unit 6*a* is connected to the other terminal of the discharge lamp 5*a*. The lamp current detecting unit 6*a* includes a lamp current detecting resistor Ra and a rectifier diode Da, a lamp current flowing through the discharge lamp 5*a* is converted into a voltage by the lamp current detecting resistor Ra, and the voltage is rectified by the rectifier diode Da connected to the connection portion of the discharge lamp 5*a* and the lamp current detecting resistor Ra and is outputted as the aforementioned output signal (i.e., an output voltage) 9 of the lamp current detecting unit 6*a* so as to be fed to the control circuit 2 and also to the non-inverting input terminal of an operational amplifier 8 to constitute a lamp current controlling circuit 7*b* for the discharge lamp 5*b*.

A lamp current controlling circuit 7*a* is connected to a control winding 11*b* of the transformer 4A. In the present embodiment, the lamp current controlling circuit 7*a* is a constant current circuit including transistors Q5 and Q6, a zener diode ZD, and resistors R3 and R4, and the circuit constants of these components are set by the constant current flowing through the control winding 11*b* so that the inductance LAv of the control winding 11*a* of the transformer 4A is maintained at a predetermined value to be described later. A snubber circuit including a capacitor C4 and a resistor R5 connected in series to each other is connected across both terminals of the control winding 11*b* in order to prevent a high spike voltage when back-emf is generated.

A lamp current detecting unit 6*b* is connected to the other terminal of the discharge lamp 5*b*. The lamp current detecting unit 6*b* includes a lamp current detecting resistor Rb and a rectifier diode Db, a lamp current flowing through the discharge lamp 5*b* is converted into a voltage by the lamp current detecting resistor Rb, and the voltage is rectified by the rectifier diode Db connected to the connection portion of the discharge lamp 5*b* and the lamp current detecting resistor Rb and is outputted to be fed to the inverting input terminal of the operational amplifier 8 of the lamp current controlling circuit 7*b*.

The lamp current controlling circuit 7*b* is connected a control winding 12*b* of the transformer 4B. In the present embodiment, the output signal (output voltage) 9 from the lamp current detecting unit 6*a* is inputted as a reference voltage to the non-inverting terminal of the operational amplifier 8 of the lamp current controlling circuit 7*b*, and output voltage from the lamp current detecting unit 6*b* is compared to the reference voltage, and a resultant output is applied to the base of a transistor Q7. The collector terminal of the transistor Q7 is connected to the control winding 12*b* of the transformer 4B, and the inductance value of the winding 12*a* is controlled by the collector current of the transistor Q7 which is caused to increase and decrease according to the output voltage of the operational amplifier 8, that is to say, controlled by the fluctuation of the current flowing through the control winding 12*b*. A snubber circuit including a capacitor C4 and a resistor R5 connected in series to each other is connected across both terminals of the control winding 12*b* in order to prevent a high spike voltage when back-emf is generated.

In the present embodiment, the transformers 4A and 4B are variable inductance elements having an identical performance characteristic. The transformers 4A and 4B operate such that the inductances LAv and LBv of the windings 11*a* and 12*a* are caused to decrease when the currents flowing through the control windings 11*b* and 12*b* increase, and the variable range is expressed as $Lmin<Lv<Lmin+\Delta L$, where $\Delta L$ is a variation width, and Lmin is the minimum inductance value which is determined according to a prescribed impedance required for allowing the transformers 4A and 4B to fulfill the function of a current suppressing element to light in parallel the plurality of discharge lamps 5*a* and 5*b* connected to the step-up transformer 3, wherein if the discharge lamps 5*a* and 5*b* are cold-cathode tubes having a length of about 500 mm, Lmin is required to have a value of about 130 mH. In the present embodiment, the lamp current controlling circuit 7*a* which is a constant current circuit is connected to the control winding 11*b* of the transformer 4A connected to the discharge lamp 5*a*, and the inductance LAv of the winding 11*a* is maintained approximately at $Lmin+\Delta L/2$ (i.e., near the median value of the variable range) by the constant current flowing through the control winding 11*b*. In the discharge lamp light apparatus 10 thus structured, a lamp current control is performed based on the lamp current of the discharge lamp 5*a* as a reference lamp.

The operation of the discharge lamp lighting apparatus 10 will be explained. For this explanation, the basic operations of the lamp current controlling circuit 7*b* and the transformer 4B for maintaining the lamp current of the discharge lamp 5*b* at a predetermined value will be first explained.

In the lamp current controlling circuit 7*b*, if the lamp current of the discharge lamp 5*b* goes down below a prescribed value and therefore the output voltage of the lamp current detecting unit 6*b* decreases, then an electric potential difference Vd between both input terminals of the operational amplifier 8 is caused to increase. As a result, the output voltage of the operational amplifier 8 increases, the base current of the transistor Q7 increases, and the collector current of the transistor Q7 is increased, that is to say, the current flowing through the control winding 12*b* of the transformer 4B is increased. This causes the inductance LBv of the control winding 12*b* of the transformer 4B to decrease, and the resonant frequency $f_0$ [$f_0=1/2\pi\sqrt{(Le+LBv)\times(C1+Cp)}$ - - - formula (1)] of the resonant circuit including the transformer 4B formed at the secondary side of the step-up transformer 3 increases. Since the driving frequency at the primary side of the step-up transformer 3 is set higher than the resonant frequency $f_0$ of the resonant circuit, the resonant frequency $f_0$ comes closer to the driving frequency at the primary side of the step-up transformer 3, which results in a decreased impedance of the resonant circuit at the driving frequency thus increasing the lamp current flowing through the discharge lamp 5*b*.

On the other hand, if the lamp current of the discharge lamp 5*b* goes up above the prescribed value and therefore the output voltage of the lamp current detecting unit 6*b* increases, then the electric potential difference Vd between both input terminals of the operational amplifier 8 is caused to decrease. As a result, the output voltage of the operational amplifier 8 decreases, the base current of the transistor Q7 decreases, and the collector current of the transistor Q7 is decreased, that is to say, the current flowing through the control winding 12*b* of the transformer 4B is decreased. This causes the inductance LBv of the control winding 12*b* of the transformer 4B to increase, and the resonant frequency $f_0$ of the resonant circuit including the transformer 4B formed at the secondary side of the step-up transformer 3 decreases thus getting away from the driving frequency at the primary side of the step-up transformer 3, which is set higher than the resonant frequency $f_0$ of the resonant circuit. As a result, the impedance of the resonant circuit at the driving frequency is increased thus decreasing the lamp current flowing through the discharge lamp 5*b*.

Generally, the aforementioned prescribed value for the lamp current of the discharge lamp 5*b*, which is maintained by the operation of the lamp current controlling circuit 7*b* and the transformer 4B, is determined according to the reference voltage inputted to the operational amplifier 8. In the discharge lamp lighting apparatus 10 according to the present embodiment, the output signal (output voltage) 9 of the lamp current detecting unit 6*a* for the discharge lamp 5*a* acts as the reference voltage, and accordingly the prescribed value is determined to the lamp current of the discharge lamp 5*a*. Particularly, in the present embodiment, the value itself of the lamp current flowing through the discharge lamp 5*a* is assumed to be set at the prescribed value for the lamp current of the discharge lamp 5*b* by properly selecting the circuit constants of the lamp current detecting resistor Ra of the lamp current detecting unit 6*a*, the lamp current detecting resistor Rb of the lamp current detecting unit 6*b*, and the components of the lamp current controlling circuit 7*b*.

In connection with the above explanation of the operations of the lamp current controlling circuit 7*b* and the transformer 4B, the description "the lamp current of the discharge lamp 5*b* goes down below/goes up above the prescribed value" means not only that the lamp current of the discharge lamp 5*b* decreases/increases, but also that the lamp current of the discharge lamp 5*a* increases/decreases and the reference voltage goes up/down. In such a case, the lamp current of the discharge lamp 5*b* is duly controlled by the above-described operations of the lamp current controlling circuit 7*b* and the transformer 4B so as to correspond to an increased/decreased value of the lamp current of the discharge lamp 5*a*. Thus in the discharge lamp lighting apparatus 10 according to the present invention, the value of the lamp current of the discharge lamp 5*b* is controlled to constantly agree to the value of the lamp current of the discharge lamp 5*a* as a reference lamp.

The lamp current control to match the lamp currents of the discharge lamps 5*a* and 5*b* is performed by variably controlling the inductance LBv of the winding 12*a* of the transformer 4B so as to allow its value to range in the vicinity of the value of the inductance LAv of the winding 11*a* of the transformer 4A, wherein since the inductance LAv of the winding 11*a* of the transformer 4A is set and maintained approximately at Lmin+ΔL/2, and since the transformer 4A and the transformer 4B are variable inductance elements having an identical performance characteristic, the inductance LBv of the winding 12*a* of the transformer 4B is also variably controlled so as to have its value maintained near the median value of the variable range (Lmin+ΔL/2).

Also, in the discharge lamp lighting apparatus 10, the output signal (output voltage) 9 of the lamp current detecting unit 6*a* for the discharge lamp 5*a* is connected to the control circuit 2, and the control circuit 2 controls the switching-on/off operation of the transistors Q1, Q2, Q3 and Q4 based on the output signal 9, whereby the lamp currents of the discharge lamps 5*a* and 5*b* are controlled. Though the present invention is not limited to any specific mode of lamp current control, the control circuit 2 generates the gate driving signals d1 to d4 for the transistors Q1 to Q4 preferably by a pulse width modulation (PWM) control, where the output voltage 9 fed back from the lamp current detecting unit 6 acts as the reference voltage to determine the pulse widths of the gate driving signals d1 to d4, and electric power supplied to the primary winding Np of the step-up transformer 3 is adjusted by varying on-duty times of the transistors Q1 to Q4 according to the output signal (voltage) 9, whereby the lamp currents of all the discharge lamps including the discharge lamp 5*a* as a reference lamp are controlled to be kept at a prescribed value.

When the lamp current of the discharge lamp 5*a* as a reference lamp is adjusted at a new value by the control circuit 2 performing the driving control of the switching elements as described above, even if there is a variance between the lamp current of the discharge lamp 5*a* and the lamp current of the other discharge lamp 5*b*, the lamp current of the discharge lamp 5*b* is automatically adjusted to the lamp current of the discharge lamp 5*a* by the above-described operations of the lamp current controlling circuit 7*b* and the transformer 4B.

Figure 5:
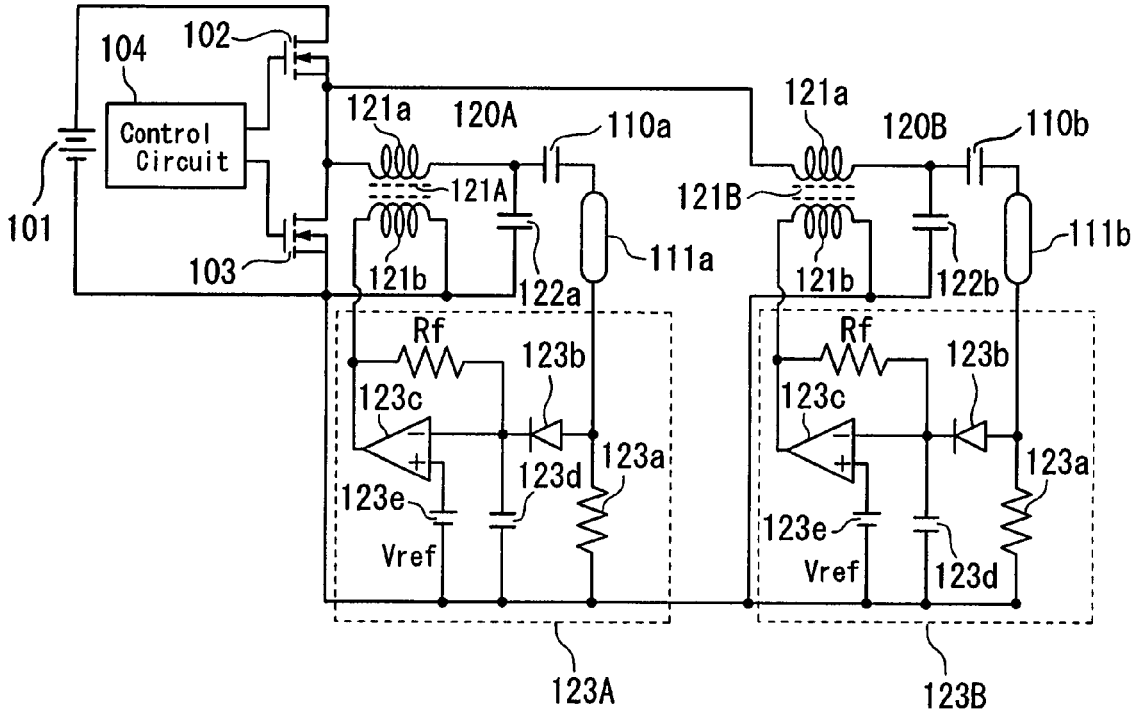
FIG. 5 PRIOR ART
FIG. 5 is a circuitry of a conventional discharge lamp lighting apparatus for lighting a plurality of discharge lamp.

The operation of the discharge lamp lighting apparatus 10 in the present embodiment is similar to the operation of the conventional discharge lamp lighting apparatus shown in FIG. 5 in that the lamp current flowing through the discharge lamp is controlled by varying the inductance value of the variable inductance element. The conventional discharge lamp apparatus of FIG. 5, however, requires provision of the capacitors 110*a* and 110*b* for limiting current, which are connected in series to the discharge lamps 111*a* and 111*b*, respectively, in order to stabilize the lamp currents of the discharge lamps 111*a* and 111*b*. And, the resonant frequency $f_0$ of the series resonant circuit 120A is expressed as $f_0=1/2\pi\sqrt{Lv\times C1}$ - - - formula (2), where Lv is an inductance of the orthogonal transformer 121A, and C1 is a capacitance of the capacitor 122*a*, and the inductance required for controlling the lamp current is adjusted only by the inductance Lv of the orthogonal transformer 121A.

On the other hand, since the discharge lamp lighting apparatus 10 of FIG. 1 according to the present embodiment defines a circuitry having the step-up transformer 3, the resonant circuit formed at the secondary side of the step-up transformer 3 includes the leakage inductance Le of the step-up transformer 3, and the resonant frequency $f_0$ is expressed as $f_0=1/2p\sqrt{(Le+Lv)\times(C1+Cp)}$ - - - formula (3), where Lv is either LAv or LBv shown in FIG. 1. Thus, the inductance required for controlling the lamp current is adjusted by the leakage inductance Le of the step-up transformer 3 as well as the inductance Lv of the variable inductance element, and therefore the variable inductance element can be downsized. Also, since the leakage inductance Le of the step-up transformer 3 and the inductance Lv of the variable inductance element function as a capacitor for limiting current, no capacitor for limiting current is additionally required.

The discharge lamp lighting apparatus 10 of FIG. 1 is described, by way of example, as lighting two discharge lamps, that is to say, the discharge lamp 5*a* as a reference lamp and the discharge lamp 5*b* as a controllable lamp, but can be adapted to light more than two discharge lamps, only if more than three secondary side lighting circuits each including a discharge lamp are connected in parallel to the secondary side of the step-up transformer 3.

Figure 2:
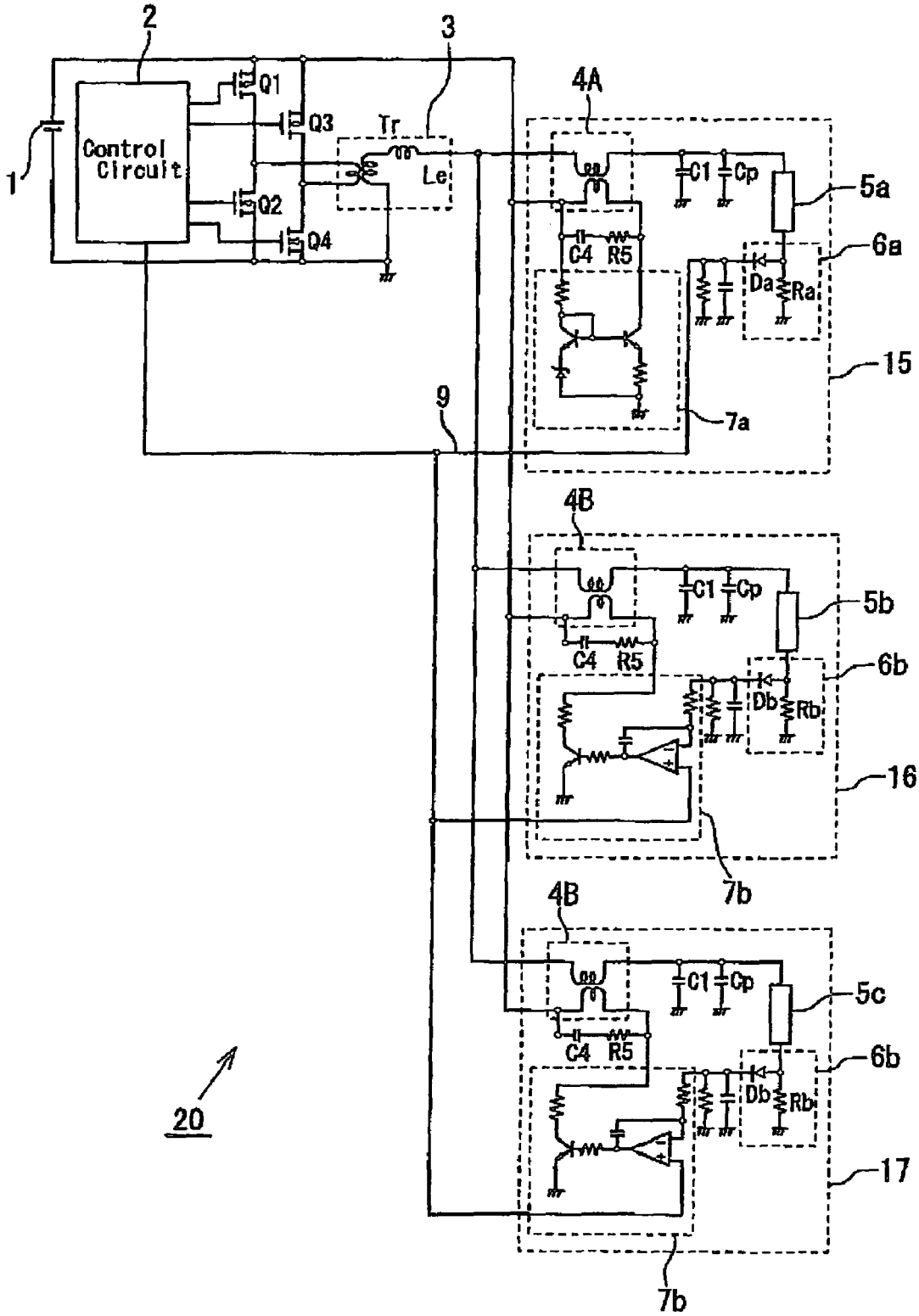
FIG. 2 is a circuitry of a discharge lamp lighting apparatus for lighting a plurality of discharge lamps, according to a second embodiment of the present invention.

Referring to FIG. 2, a discharge lamp lighting apparatus 20 according to a second embodiment of the present invention is for lighting three discharge lamps 5*a*, 5*b* and 5*c*. In the discharge lamp lighting apparatus 20, the discharge lamp 5*c* as another controllable lamp is connected to a secondary side lighting circuit 17 which is identical with the secondary side lighting circuit 16 including the discharge lamp 5*b* shown in FIG. 1, and which is connected, in parallel with secondary side lighting circuits 15 and 16, to the secondary side of a step-up transformer 3. The discharge lamp lighting apparatus 20 operates in the same way as the discharge lamp lighting apparatus 10 of FIG. 1, and the lamp currents of the discharge lamps 5*b* and 5*c* as controllable lamps are controlled to match up to the lamp current of the discharge lamp 5*a* as a reference lamp.

Figure 3:
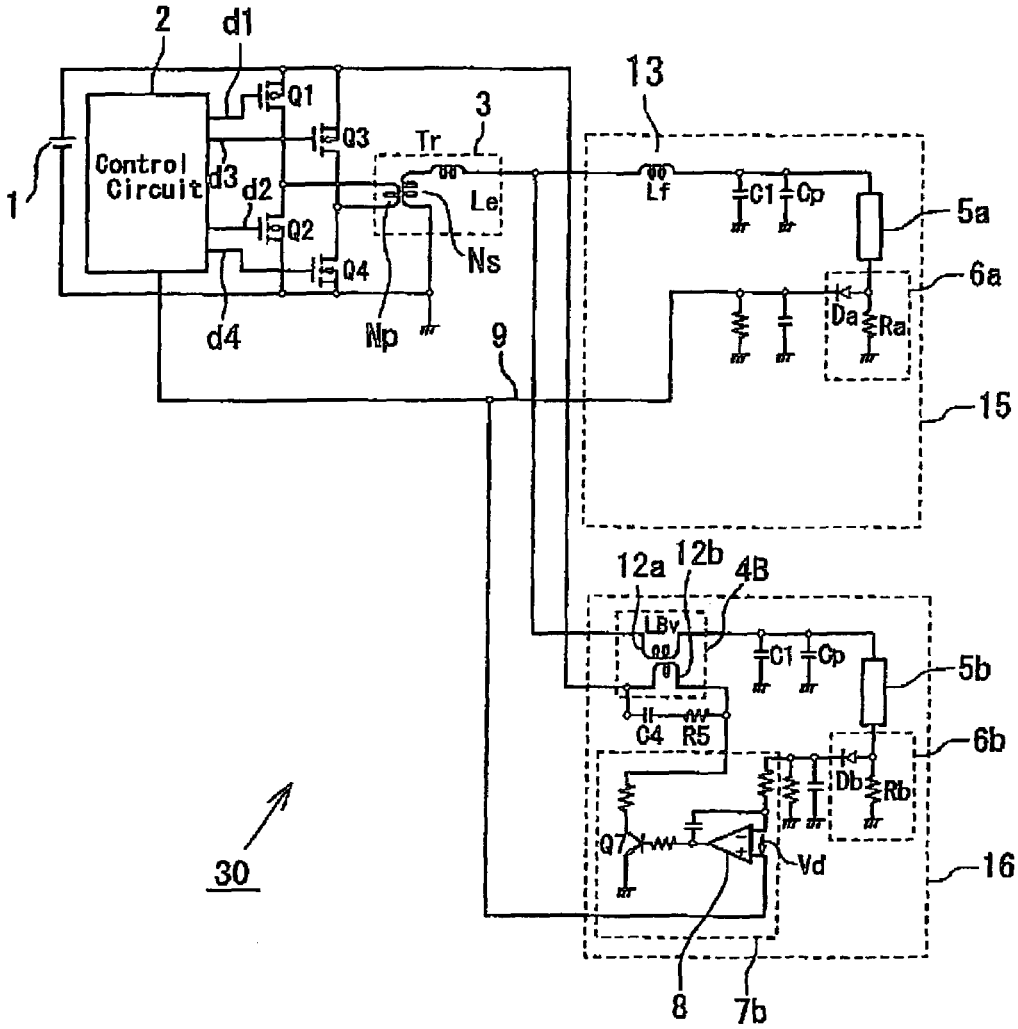
FIG. 3 is a circuitry of a discharge lamp lighting apparatus for lighting a plurality of discharge lamps, according to a third embodiment of the present invention.

Referring now to FIG. 3, a discharge lamp lighting apparatus 30 according to a third embodiment of the present invention employs an inductor (ordinary inductor) 13 as an inductance element in a secondary side lighting circuit 15 including a discharge lamp 5*a* as a reference lamp, in place of the transformer 4A and the lamp current controlling circuit 7*a* connected to the control winding 11*b* (refer to FIGS. 1 and 2). This circuitry reduces the number of components thereby contributing to reduction in cost. In this connection, an inductance Lf of the inductor 13 is set at Lmin+ΔL/2 in order to control an inductance LBv of a winding 12*a* of a transformer 4B near the median value (1 min+ΔL/2) of the variable range, and since the inductor 13 generally has a magnetic characteristic different from that of a variable inductance element, a careful design work is required. The selection between the discharge lamp lighting apparatus 10 of FIG. 1 and the discharge lamp lighting apparatus 30 of FIG. 3 is to be made in view of performance, cost, and the like.

Figure 4:
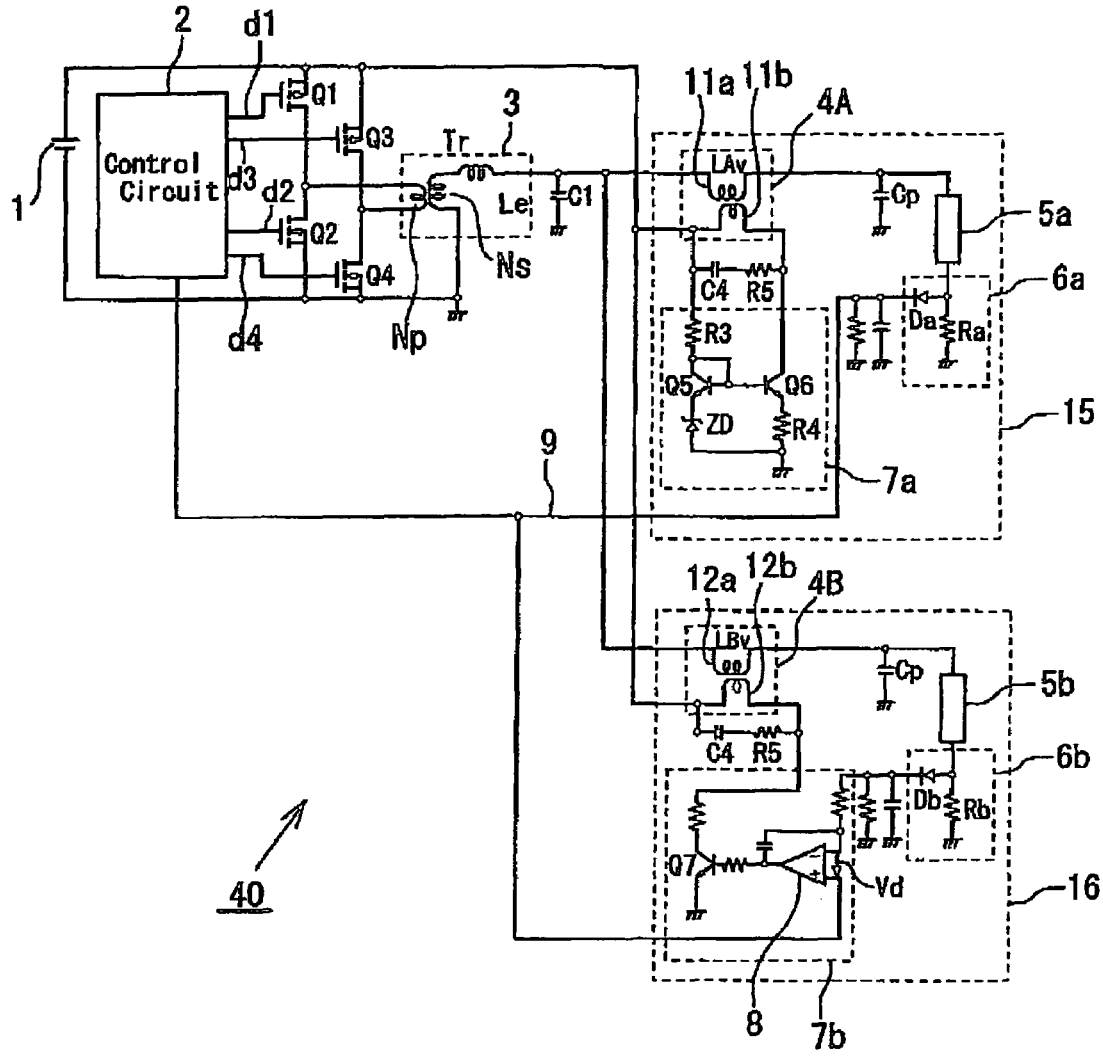
FIG. 4 is a circuitry of a discharge lamp lighting apparatus for lighting a plurality of discharge lamps, according to a fourth embodiment of the present invention.

Referring further to FIG. 4, in a discharge lamp lighting apparatus 40 according to a fourth embodiment of the present invention, only one capacitor C1 for adjusting resonant frequency is provided directly at the secondary side of a step-up transformer 3, rather than individually at each of secondary side lighting circuits 15 and 16. This circuit reduces the number of components thereby contributing to reduction in cost. In this circuitry, inductances LAv and LBv of transformers 4A and 4B as variable inductance elements are made to allow a variation width to fully compensate for a variance of each stray capacitance Cp. The selection between the discharge lamp lighting apparatus 10 of FIG. 1 and the discharge lamp lighting apparatus 40 of FIG. 4 is to be made in view of performance, cost, and the like.

In the foregoing descriptions of the discharge lamp lighting apparatuses according to the present invention, the lamp currents of the discharge lamps as controllable lamps are controlled to equally match up to the lamp current of the discharge lamp as a reference lamp, but alternatively the lamp currents of all the discharge lamps may be individually controlled to match up to respective different values predetermined in view of factors influencing the brightness of the discharge lamps, such as temperature distribution of a backlight device in which the discharge lamp lighting apparatus is disposed. This can be implemented by individually adjusting the values of the lamp current detecting resistors of the lamp current detecting units.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A discharge lamp lighting apparatus for lighting a plurality of discharge lamps, the apparatus comprising:

a DC power supply;

a control circuit to output signals;

a step-up transformer defining a primary side and a secondary side;

switching elements connected to the DC power supply, the switching elements driving the primary side of the step-up transformer based on the signals from the control circuit so as to light the plurality of discharge lamps which include one reference discharge lamp and at least one controllable discharge lamp, and which are connected to the secondary side of the step-up transformer;

a first variable inductance element provided between one terminal of the secondary side of the step-up transformer and one terminal of the reference discharge lamp, a first lamp current detecting unit connected to the other terminal of the reference discharge lamp;

a first lamp current controlling circuit connected to the first variable inductance element;

a first series resonant circuit constituted by a leakage inductance of the step-up transformer, an inductance of the first variable inductance element, and a composite capacitance of a capacitance element with a stray capacitance provided between the first variable inductance element and the reference discharge lamp;

at least one second variable inductance element provided between the one terminal of the secondary side of the step-up transformer and one terminal of the controllable discharge lamp;

at least one second current detecting unit connected to the other terminal of the controllable discharge lamp;

at least one second lamp current controlling circuit connected to the second variable inductance element; and at least one second series resonant circuit constituted by the leakage inductance of the step-up transformer, an inductance of the second variable inductance element, and a composite capacitance of a capacitance element with a stray capacitance provided between the second variable inductance element and the controllable discharge lamp, wherein an output signal from the first lamp current detecting unit connected to the reference discharge lamp and also an output signal from the second lamp current detecting unit connected to the controllable discharge lamp are connected to the second lamp current controlling circuit for the controllable discharge lamp, and wherein an output signal from the second lamp current controlling circuit for the controllable discharge lamp is connected to the second variable inductance element for the controllable discharge lamp so as to vary the inductance of the second variable inductance element for the controllable discharge lamp thereby controlling a lamp current of the controllable discharge lamp.

2. A discharge lamp lighting apparatus according to claim 1, wherein the output signal from the first lamp current detecting unit for the reference discharge lamp is also connected to the control circuit so that the control circuit controls on/off operation of the switching elements according to the output signal from the first lamp current detecting unit for the reference discharge lamp.

3. A discharge lamp lighting apparatus according to claim 1, wherein the first lamp current controlling circuit for the reference discharge lamp is a constant current circuit, and the inductance of the first variable inductance element functioning for the reference discharge lamp and connected to the constant current circuit is maintained approximately at $Lmin+\Delta L/2$, where Lmin is a minimum value of the inductance of the first variable inductance element for the reference discharge lamp, and $\Delta L$ is a variance width of the first variable inductance element for the reference discharge lamp.

4. A discharge lamp lighting apparatus according to claim 1, wherein the second lamp current controlling circuit for the controllable discharge lamp comprises an operational amplifier and a transistor, the output signal from the second lamp current detecting unit for the controllable discharge lamp and the output signal from the first lamp current detecting unit for the reference discharge lamp are inputted to the operational amplifier, an output from the operational amplifier is connected to a base terminal of the transistor, and a collector terminal of the transistor is connected to the second variable inductance element for the controllable discharge lamp, whereby the inductance of the second variable inductance element for the controllable discharge lamp is variably controlled.

5. A discharge lamp lighting apparatus according to claim 1, wherein the first and second variable inductance elements each constitute a transformer, and a snubber circuit is connected across both terminals of a control winding of the transformer.

6. A discharge lamp lighting apparatus according to of claim 1, wherein the discharge lamp lighting apparatus is incorporated in a backlight device for a liquid crystal display apparatus.

7. A discharge lamp lighting apparatus for lighting a plurality of discharge lamps, the apparatus comprising:

a DC power supply;

a control circuit to output signals;

a step-up transformer defining a primary side and a secondary side;

switching elements connected to the DC power supply, the switching elements driving the primary side of the step-up transformer based on the signals from the control circuit so as to light the plurality of discharge lamps which include one reference discharge lamp and at least one controllable discharge lamp, and which are connected to the secondary side of the step-up transformer;

an inductance element provided between one terminal of the secondary side of the step-up transformer and one terminal of the reference discharge lamp;

a first lamp current detecting unit connected to the other terminal of the reference discharge lamp;

a first series resonant circuit constituted by a leakage inductance of the step-up transformer, an inductance of the inductance element, and a composite capacitance of a capacitance element with a stray capacitance provided between the variable inductance element and the reference discharge lamp;

at least one variable inductance element provided between the one terminal of the secondary side of the step-up transformer and one terminal of the controllable discharge lamp;

at least one second lamp current detecting unit connected to the other terminal of the controllable discharge lamp;

at least one lamp current controlling circuit connected to the variable inductance element; and at least one second series resonant circuit constituted by the leakage inductance of the step-up transformer, an inductance of the variable inductance element, and a capacitance of capacitance element together with a stray capacitance provided between the variable inductance element and the controllable discharge lamp, wherein an output signal from the first lamp current detecting unit connected to the reference discharge lamp and also an output signal from the second lamp current detecting unit connected to the controllable discharge lamp are connected to the lamp current controlling circuit for the controllable discharge lamp, and wherein an output signal from the lamp current controlling circuit for the controllable discharge lamp is connected to the variable inductance element for the controllable discharge lamp so as to vary the inductance of the variable inductance element for the controllable discharge lamp thereby controlling a lamp current of the controllable discharge lamp.

8. A discharge lamp lighting apparatus for lighting a plurality of discharge lamps, the apparatus comprising:

a DC power supply;

a control circuit to output signals;

a step-up transformer defining a primary side and a secondary side;

switching elements connected to the DC power supply, the switching elements driving the primary side of the step-up transformer based on the signals from the control circuit so as to light the plurality of discharge lamps which include one reference discharge lamp and at least one controllable discharge lamp, and which are connected to the secondary side of the step-up transformer;

a capacitance element provided at one terminal of the secondary side of the step-up transformer;

a first variable inductance element provided between the capacitance element and one terminal of the reference discharge lamp, a first lamp current detecting unit connected to the other terminal of the reference discharge lamp;

a first lamp current controlling circuit connected to the first variable inductance element;

a series resonant circuit constituted by a leakage inductance of the step-up transformer and a capacitance of the capacitance element;

at least one second variable inductance element provided between the capacitance element and one terminal of the controllable discharge lamp;

at least one second current detecting unit connected to the other terminal of the controllable discharge lamp; and at least one second lamp current controlling circuit connected to the second variable inductance element, wherein an output signal from the first lamp current detecting unit connected to the reference discharge lamp and also an output signal from the second lamp current detecting unit connected to the controllable discharge lamp are connected to the second lamp current controlling circuit for the controllable discharge lamp, and wherein an output signal from the second lamp current controlling circuit for the controllable discharge lamp is connected to the second variable inductance element for the controllable discharge lamp so as to vary the inductance of the second variable inductance element for the controllable discharge lamp thereby controlling a lamp current of the controllable discharge lamp.

* * * * *